US006195799B1

(12) United States Patent
Davies

(10) Patent No.: US 6,195,799 B1
(45) Date of Patent: Mar. 6, 2001

(54) NECK PROTECTOR APPARATUS

(76) Inventor: Vikki S. Davies, 105 Quale Haven, Hubert, NC (US) 28539

( * ) Notice: Subject to any disclaimer, the term of this patent is extended or adjusted under 35 U.S.C. 154(b) by 0 days.

(21) Appl. No.: 09/347,749

(22) Filed: Jul. 6, 1999

Related U.S. Application Data

(60) Provisional application No. 60/093,309, filed on Jul. 17, 1999.

(51) Int. Cl.[7] ..... A41D 13/00
(52) U.S. Cl. ..... 2/50; 2/468
(58) Field of Search ..... 2/174, 468, 49.4, 2/50, 46, 49.1, 52, 48

(56) References Cited

U.S. PATENT DOCUMENTS

| | | | | |
|---|---|---|---|---|
| 797,434 | * | 8/1905 | Homeyer | 2/49.4 |
| 2,470,833 | * | 5/1949 | Moore | 2/174 |
| 2,493,363 | * | 1/1950 | Sapp | 2/174 |
| 2,769,980 | | 11/1956 | Fleischer | 2/174 |
| 2,851,690 | * | 9/1958 | Jennings | 2/50 |
| 2,947,004 | | 8/1960 | Pfile | 2/50 |
| 3,283,344 | * | 11/1966 | Blanchard | 2/174 |
| 4,615,047 | * | 10/1986 | Matsuoka | 2/50 |
| 4,709,420 | * | 12/1987 | Gettinger | 2/50 |
| 5,079,777 | * | 1/1992 | Fowler et al. | 2/50 |
| 5,469,580 | | 11/1995 | Sobol | 2/50 |
| 5,572,740 | * | 11/1996 | Geniesse | 2/50 |
| 5,628,070 | * | 5/1997 | Kefelian | 2/174 |

* cited by examiner

*Primary Examiner*—Amy B. Vanatta
(74) *Attorney, Agent, or Firm*—Rodger H. Flagg

(57) ABSTRACT

The neck protector includes a cushioned pad which is quilted to cushion and insulate the user's head from direct contact with a salon sink, during washing and shampooing operations. The neck protector also serves to keep the heat of a dryer from the user's lower neck. The neck protector has a substantially straight front surface, and a substantially curved back surface. Attachment devices extend from opposing ends of the substantially straight front surface, and are of a length suitable for securing the neck protector about the user's neck. The quilted portion extends from the center of the substantially straight front surface. The neck protector is preferably made to be disposable.

13 Claims, 2 Drawing Sheets

NECK PROTECTOR APPARATUS

CROSS-REFERENCES TO RELATED APPLICATIONS

This is a utility application, having priority from provisional patent application, Ser. No. 60/093,309 filed on Jul. 17, 1999.

BACKGROUND OF THE INVENTION

1. Field of the Invention

The present application relates generally to salon equipment and more specifically to a neck protector apparatus for use in washing, shampooing or treating a person's hair.

2. Discussion of the Prior Art

A salon sink is cold, hard and uncomfortable, particularly when a person leans back to rest their head over the sink to have their hair washed or shampooed. The neck protector apparatus provides a cushioned surface between the user's neck and the sink.

Rigid trays are available to direct the liquid from the user's hair into the salon sink. However, they too are cold, hard and uncomfortable, and must be washed between each use for sanitary reasons.

Capes and shields are also known in the art which generally conform about the user's neck. These devices do not provide a cushioned surface between the user and the edge of the sink. The prior art includes the following:

U.S. Pat. No. 5,469,580 issuing Nov. 28, 1995 to Brigitte Sobol discloses a shampoo cape of pliable material which has semi-rigid elongate side members. A detachable strap is used to hold the cape in position about the user's head.

U.S. Pat. No. 2,769,980 issuing to J. Fleischer on Nov. 13, 1956 discloses a heat resistant material, such as plastic or aluminum foil, which is attached to the user's ears and fits about the user's neck. A curved, cutaway edge is provided to generally conform to the user's neck.

U.S. Pat. No. 2,947,004 issuing to G. Pfile on Aug. 2, 1960 discloses a garment protector of absorbent, washable material. The garment protector has a generally semi-circular front and rear portions.

There exists a need for a comfortable, conforming, disposable neck protector, having a cushioned pad positioned to comfortably rest the user's neck upon the edge of the salon sink, for ease of washing and shampooing the user's hair.

SUMMARY OF THE INVENTION

The neck protector disclosed herein, includes an internal, cushioned pad. The neck protector is hypo-allergenic, with attachment devices to provide a secure fit about the user's neck. The neck protector is quilted to cushion and insulate the user's head from direct contact with a salon sink, during washing and shampooing operations. The neck protector also serves to keep the heat of a dryer from the user's lower neck. The cushioned pad has a substantially straight front surface, and a substantially curved back surface. Suitable attachment devices extend from opposing ends of the substantially straight front surface, and are of a length suitable for securing the neck protector about the user's neck. The quilted portion originates from the center of the substantially straight front surface, towards the substantially curved back surface.

Further objects, features and advantages of this invention, and the manner of attaining them, will be apparent from the following detailed description of a preferred embodiment of the invention, when taken in conjunction with the accompanying drawings.

DETAILED DESCRIPTION OF THE PREFERRED EMBODIMENT

Figure 1:
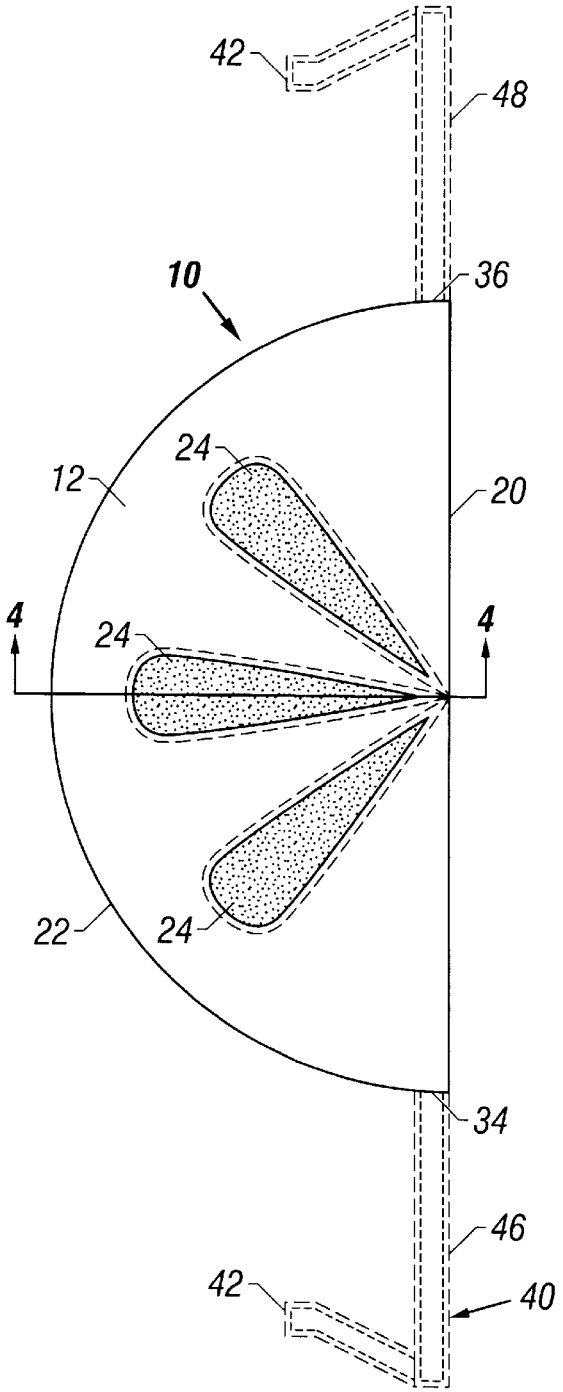
FIG. 1 is a top view of the neck protector prior to use in accordance with the present invention.

With reference now to the drawings, and particularly to FIG. 1, there is shown a top view of a neck protector apparatus 10. With reference to FIGS. 2–5, the neck protector apparatus 10 comprises a first sheet 12 and a second sheet 14, with a padding layer 16 there-between. The assembled first sheet 12, second sheet 14 and padding layer 16 are secured together by any known securement means 18, such as sewing, stitching, gluing, sonic welding, heat sealing, laser welding, etc. Due to the low cost of materials and labor, the neck protector apparatus 10 may be economical enough to be disposable, for ease of clean-up and for sanitation purposes.

The first sheet 12 is preferably made of a flexible, soft, absorbent covering material. The second sheet 14 is preferably made of a flexible, non-porous material. The soft, absorbent covering material of the first sheet 12 is preferably placed adjacent to the user's hair. The non-porous material of the second sheet 14 is placed against the sink, to protect the sink against harsh chemicals, dyes, and flaking skin left behind by the user.

Figure 4:
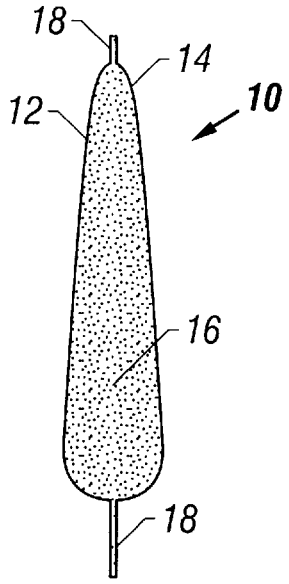
FIG. 4 is a cross sectional view of the neck protector taken along lines 4—4 in FIG. 1 in accordance with the present invention.
Figure 3:
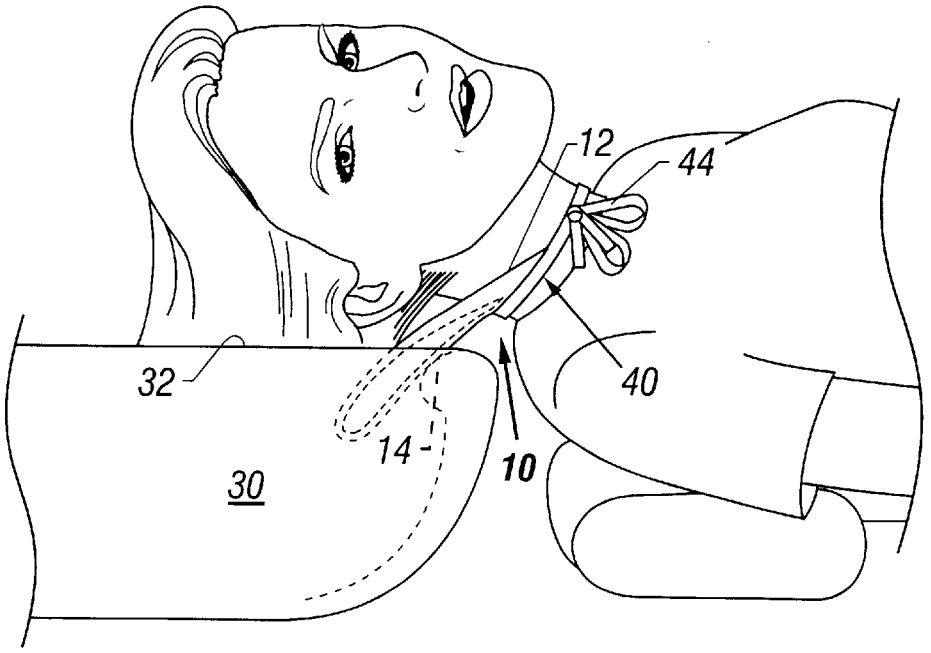
FIG. 3 is a side view showing the neck protector positioned between the user and the salon sink in accordance with the present invention.

Alternately, where desired, the non-porous second layer 14 may be placed adjacent to the user's hair. Both first sheet 12 and second sheet 14 may alternately be made of the soft, absorbent covering material, to suit client or manufacturing preference. Likewise, both the first and second sheets may alternately be made of non-porous material, to suit client or manufacturing preference. As shown in FIG. 4, the padding layer 16 is preferably filled with a polyester, fiber or foam material, having a preferable material thickness of one-eighth of an inch to about one and one-half inch in thickness.

Figure 2:
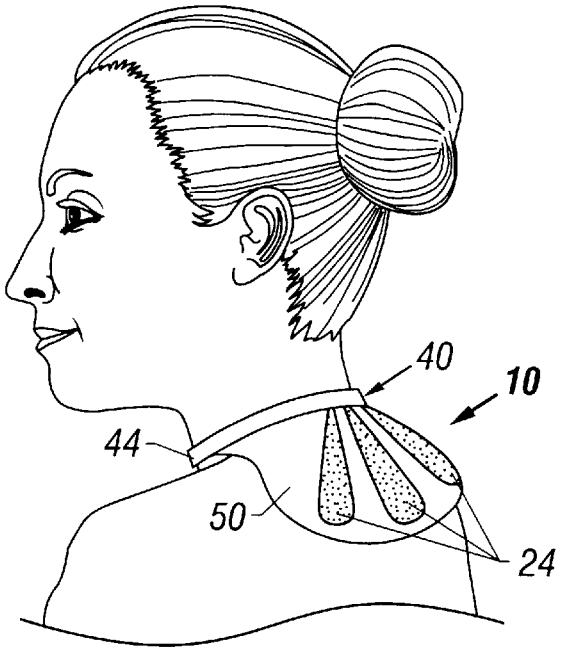
FIG. 2 is a perspective view of the neck protector placed about the user's neck in accordance with the present invention.

With reference to FIG. 2, the first sheet 12 may include indicia 50, such as color, patterns, logo, texturing, lettering, numbering or designs to suit manufacturing preference. Likewise, the second sheet 12 may also include indicia 50, such as color, patterns, logo, texturing, lettering, numbering or designs. Preferably, the indicia 50 on the first sheet 12 is different from the indicia on the second sheet 14, to identify the porous sheet 12 side from the non-porous sheet 14 side, for ease of positioning the porous first sheet 12 adjacent to the user's hair.

As shown in FIG. 1, the neck protector 10 has a substantially straight front surface 20, and a substantially curved back surface 22. The shape of the first and second sheets is preferably a substantially semi-circular shape. When the first sheet 12, the padding layer 16 and the second sheet 14 are secured together by a suitable securement means 18, creating preferably three raised quilted portions 24.

Preferably, the three raised quilted portions 24 preferably extend from the proximity of the center 26 of the substantially straight front surface towards the substantially curved back surface 22. Less than three or more than three quilted portions 24 may be formed in the neck protector 10. Each of the raised quilted portions 24 preferably increase in width from the front surface 20 to the substantially curved back surface 22. The raised quilted portions 24 further serve to relieve pressure from the parts of the neck receiving the most stress. The raised quilted portions 24 serve to cushion the user's head when placed between the user's head and the edge 32 of the salon sink 30. The raised quilted portions 24 also serve to insulate the user from the heat of a hair dryer, when used during a hair drying operation, as shown in FIG. 2. The securement means 18 preferably also extends about the outer periphery of the neck protector 10, which adds strength and partial rigidity to the neck protector apparatus 10.

An attachment device 40 is secured to the neck protector 10 to releasably secure the neck protector 10 about the user's neck. The attachment device 40 extends from opposing ends 34 and 36 of the neck protector 10, and is of a length sufficient for releasably securing the neck protector 10 to the user's neck. The attachment device 40 may be fabricated of any suitable flexible material, and preferably has a width greater than its thickness, for comfort when installed about the user's neck. The attachment device 40 may be a tie string.

The attachment ends 42 of the attachment device 40 may be releasably secured together by tying, snapping, buttoning, hooking, tape, adhesive, hook and loop fasteners, or other suitable releasable securement means 44. The attachment device 40 may extend entirely across the straight front surface 20 of the neck protector 10, to suit design or suit manufacturing preference.

Alternately, the attachment device 40 may comprise a first attachment portion 46 and a second attachment portion 48, with the first attachment portion 46 secured to the first end 34, and the second attachment portion 48 secured to the second end 36 of the neck protector 10.

Figure 5:
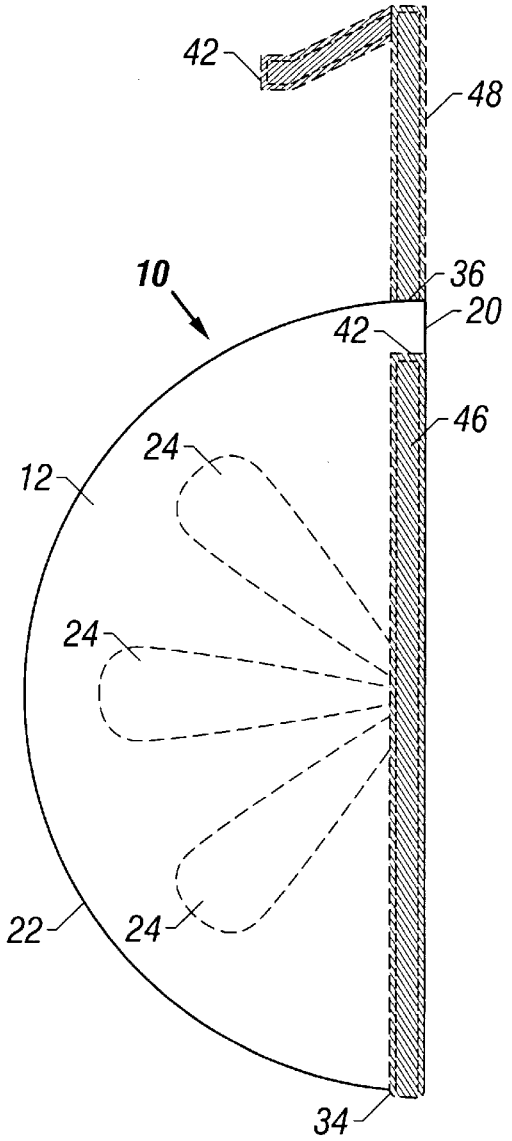
FIG. 5 is a top view of the first sheet, showing one tie string releasably secured to the first sheet, prior to use in accordance with the present invention.

With reference to FIG. 5, the first attachment portion 46 extending from the first end 34, may be releasably secured to either the first sheet 12 or the second sheet 14, for ease of packaging, transport and storage, prior to use. Likewise, the second attachment portion 48 extending from the second end 36 may be releasably secured to either the first sheet 12 or the second sheet 14, for ease of packaging, transport and storage prior to use; this eliminates the possibility of tangling multiple attachment portions 46 and 48, when multiple neck protectors 10 are packaged together. Of course, the first and second attachment portions 46 and 48 need not be releasably secured to either of the first and second sheets for the novel neck protector 10 to work for its intended purpose.

In use, the first and second attachment portions of the neck protector apparatus 10 are releasably secured about the user's neck to provide a snug fit between the substantially straight front surface 20 and the user's neck. The substantially straight front surface 20 of the neck protector apparatus 10 flexibly conforms to the user's neck, and the substantially curved back surface 22 is placed between the user's head and the salon sink 30. The quilted portions 24 are placed between the user's head and the edge 32 of the salon sink 30, providing a comfortable resting place for the user's head. Preferably, the first sheet 12 is of an absorbent material, which is placed adjacent to the user's hair, while the second non-absorbent sheet is placed adjacent to the edge of the sink. Preferably, indicia on the first sheet 12 aids the user in positioning the neck protector apparatus 10. Hair conditioning and coloring may also be performed using the neck protector 10 disclosed herein.

Upon completion of the hair treatment, the neck protector 10 may be unsecured from the user's neck, and discarded, eliminating the need to sterilize, wash or sanitize the neck protector 10 in preparation for next use. Preferably, the first sheet 12, the second sheet 14 and the padded layer 16 are selected to be biodegradable, for ease of disposal without special handling or treatment.

The neck protector 10 may be individually packaged, or multiple neck protectors may be packaged together to suit user or manufacturing preference. Several neck protectors 10 may be sequentially used during the hair treatment session. As previously noted, the neck protector assembly 10 is intended for use in a hair salon or barbershop. However, the neck protector apparatus 10 may also be used in a home environment or in a nursing home, or other places where hair is washed, treated or conditioned, without departing from the scope of this disclosure, or from the following claims.

While the neck protector apparatus 10 has been described in a preferred embodiment, it is to be understood that one of average skill in this art may make numerous adaptations and modifications, and such adaptations and modifications are intended to fall within the scope of the following claims:

I claim:

1. A neck protector apparatus for placement around a user's neck, comprising:

a) a first flexible sheet of soft absorbent covering material with a straight front surface having first and second distal ends and a substantially curved back surface extending between the first and second distal ends of the straight front surface to form said neck protector having a substantially semi-circular shape;

b) a second flexible sheet of non-porous material with a substantially straight front surface and a substantially curved back surface of a size similar to the first flexible sheet;

c) at least two padding portions disposed in spaced relation between the first sheet and the second sheet, each padding portion radially extending from proximity of a mid-point of the straight front surface towards the curved back surface, and secured there-between in a manner to form a raised quilted surface about each padding portion, with drain channels extending between each padding portion;

d) and an attachment device extending from the first and second distal ends of the straight front surface, the attachment device of a length suitable to secure the neck protector apparatus about a user's neck.

2. The neck protector apparatus of claim 1, wherein each of the padding portions has a thickness selected from a range of from one-eighth inch to one and one-half inches in thickness.

3. The neck protector apparatus of claim 1, wherein the neck protector apparatus is disposable.

4. The neck protector apparatus of claim 1, wherein the neck protector is hypo-allergenic.

5. The neck protector apparatus of claim 1, wherein the neck protector apparatus is made of bio-degradable material.

6. A neck protector apparatus for placement around a user's neck, comprising:

a) a first flexible sheet of soft absorbent covering material with a straight front surface having first and second distal ends and a substantially curved back surface extending between the first and second distal ends of the straight front surface to form said neck protector apparatus having a substantially semi-circular shape;

b) a second flexible sheet of non-porous material with a substantially straight front surface and a substantially curved back surface of a size similar to the first sheet;

c) at least three padding portions disposed in spaced relation between the first sheet and the second sheet, each padding portion radially extending from proximity of a mid-point of the straight front surface towards the curved back surface, each of the padding portions of a thickness selected from a range of from one-eighth inch to one and one-half inches in thickness, the padding portions secured between the first pliable sheet and the second pliable sheet in a manner to form a raised quilted surface about each padding portion with drain channels extending between the adjacent raised padding portions;

d) and an attachment device extending from the first and second distal ends of the straight front surface, the attachment device of a length suitable to secure the neck protector apparatus about a user's neck.

7. The neck protector apparatus of claim 6, wherein the neck protector apparatus is disposable.

8. The neck protector apparatus of claim 6, wherein the neck protector is hypo-allergenic.

9. The neck protector apparatus of claim 6, wherein the first flexible sheet, the second flexible sheet and the padding portions are each made of bio-degradable material.

10. The neck protector apparatus of claim 6, wherein:

said attachment device being a tie string.

11. A disposable neck protector apparatus for placement around a user's neck, comprising:

a) a first flexible sheet of soft biodegradable absorbent covering material with a straight front surface having first and second distal ends and a substantially curved back surface extending between the first and second distal ends of the straight front surface to form said disposable neck protector apparatus having a substantially semi-circular shape;

b) a second flexible sheet of bio-degradable non-porous material with a substantially straight front surface and a substantially curved back surface of a size similar to the first flexible sheet;

c) multiple padding portions disposed in spaced relation between the first sheet and the second sheet, each padding portion radially extending from proximity of a mid-point of the straight front surface towards the curved back surface, each of the padding portions of a thickness selected from a range of from one-eighth inch to one and one-half inches in thickness, the padding portions secured between the first flexible sheet and the second flexible sheet in a manner to form a raised quilted surface about each padding portion, with drain channels extending between the adjacent padding portions;

d) and an attachment device extending from the first and second distal ends of the straight front surface, the attachment device of a length suitable to secure the neck protector apparatus about a user's neck.

12. The neck protector apparatus of claim 11, wherein:

each said quilted portion having a thickness which is at least four times thicker than the combined thickness of said first and second sheets.

13. The neck protector apparatus of claim 11, wherein the neck protector is hypo-allergenic.

* * * * *